US005585768A

United States Patent [19]

Wei

[11] Patent Number: 5,585,768

[45] Date of Patent: Dec. 17, 1996

[54] ELECTROMAGNETIC WAVE CONVERSION DEVICE FOR RECEIVING FIRST AND SECOND SIGNAL COMPONENTS

[75] Inventor: Shih-Kuei Wei, Hsinchu, Taiwan

[73] Assignee: Microelectronics Technology Inc., Taipei, Taiwan

[21] Appl. No.: 501,412

[22] Filed: Jul. 12, 1995

[51] Int. Cl.[6] ..... H01P 5/107

[52] U.S. Cl. ..... 333/137; 333/26

[58] Field of Search ..... 333/125, 137, 333/21 A, 26

[56] References Cited

U.S. PATENT DOCUMENTS 5,043,683 8/1991 Howard ..... 333/21 A 5,245,353 9/1993 Gould ..... 333/21 A X 5,374,938 12/1994 Hatazawa et al. ..... 333/26 X 5,440,279 8/1995 Kinoshita et al. ..... 333/26

*Primary Examiner*—Paul Gensler

*Attorney, Agent, or Firm*—Merchant, Gould, Smith, Edell, Welter & Schmidt, P.A.

[57] ABSTRACT

The present invention discloses an electromagnetic wave transmission device comprising separately installed metal pins and a printed pin on a printed circuit board. The device is used to receive vertical and horizontal signals; by adjusting the positions of the internal constituent components, the objective of improving signal isolation is achieved. Under a different implementation of the present invention, the degree of isolation is improved by using a metal rod to replace a printed wire connection.

11 Claims, 6 Drawing Sheets

ELECTROMAGNETIC WAVE CONVERSION DEVICE FOR RECEIVING FIRST AND SECOND SIGNAL COMPONENTS

FIELD OF INVENTION

The present invention relates to an improvement in the degree of signal isolation in wave guides that use a double-pin construction. More specifically, the present invention employs separately installed metal pins and a printed pin to improve the degree of isolation between vertical and horizontal signals.

BACKGROUND OF THE INVENTION

According to electromagnetic theories, wave guides can be used to transmit electromagnetic waves, which can be converted into electrical current signals through the use of metal pins installed in the interior of the wave guides. As shown by FIGS. 1A and 1B, one end of a rectangular wave guide is closed which forms a back short plane at the interior, and a metal pin is installed perpendicular to the length of the wave guide and at a distance of ¼ λg. (λg is the wavelength). Therefore, vertical electromagnetic waves transmitted from the other end of the rectangular wave guide can be converted into electrical current signals for subsequent electrical applications.

However, the configuration, as shown in FIGS. 1A and 1B, can only receive vertically polarized electromagnetic wave signals. In order to simultaneously receive vertically and horizontally polarized signals, one possible implementation is shown in FIGS. 2A and 2B. A cylindrical wave guide employs separate vertical and horizontal pins to receive separately the vertically and horizontally polarized signals. However, since these two pins are on the same plane as the back short plane and at a distance of ¼ λg from the back short plane, as the vertical pin receives the vertically polarized signals, simultaneously some of the horizontally polarized signals are collected. During applications, it is hoped that horizontal signals collected by the vertical pin are kept to a minimum. This is also true for the horizontal pin collecting vertical signals. In other words, the degree of isolation between signals should be kept to a maximum. As shown in FIGS. 2A and 2B, the two pins are located on the same plane (at a reflective distance of ¼ λg from the back short plane); this is also where the reflective signals are at the strongest. Thus, the vertical pin not only receives vertical signals, but also receives the strongest horizontal signals. Although by positioning the directions of the double pins, a certain degree of signal isolation can be achieved (approximately 15–20 dB). There is still a need for improvement.

BRIEF DESCRIPTION OF THE INVENTION

The objective of the present invention is to improve isolation between signals by providing a device that combines metal pins and a printed pin on a printed circuit board in conjunction with the placements of the pins to achieve the objective. The improvement in signal isolation is over 30 dB.

It is also an objective of the present invention to use a metal rod to replace a wire connection on the printed circuit board within the double-pin set so as to improve signal isolation.

The above and other objectives, effects, and superiority of the present invention will become clear from the detailed descriptions of the actual implementations and the accompanying Figures.

EXPLANATIONS THE FIGURES

EXPLANATION OF THE PREFERRED IMPLEMENTATIONS

Figure 1A:
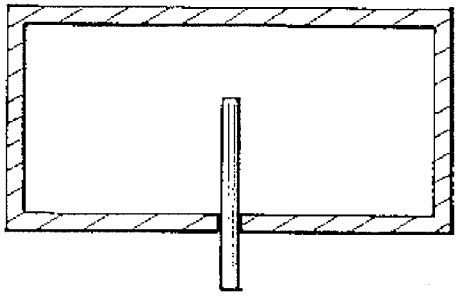
Fig. 1A (PRIOR ART)
FIGS. 1A and 1B depict the front and side views of the conventional structures of pins.
Figure 1B:
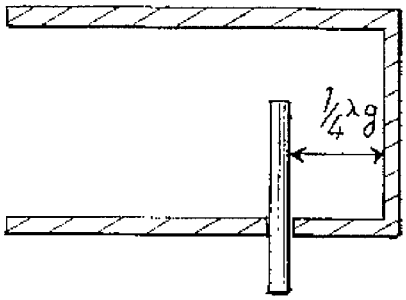
Fig. 1B (PRIOR ART)
Figure 2A:
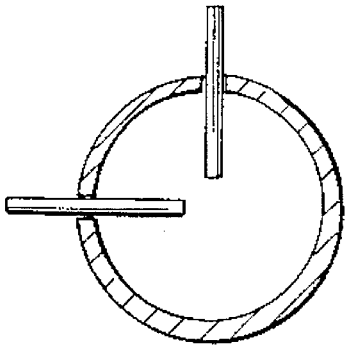
Fig. 2A (PRIOR ART)
FIG. 2A and 2B depict the front and side views of the conventional structures of the double pins.
Figure 2B:
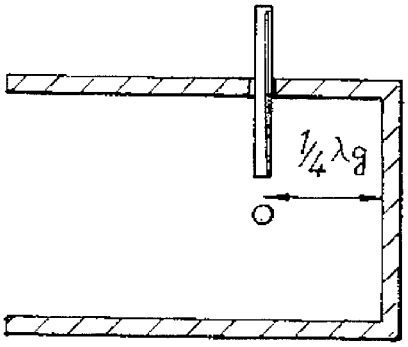
Fig. 2B (PRIOR ART)
Figure 3:
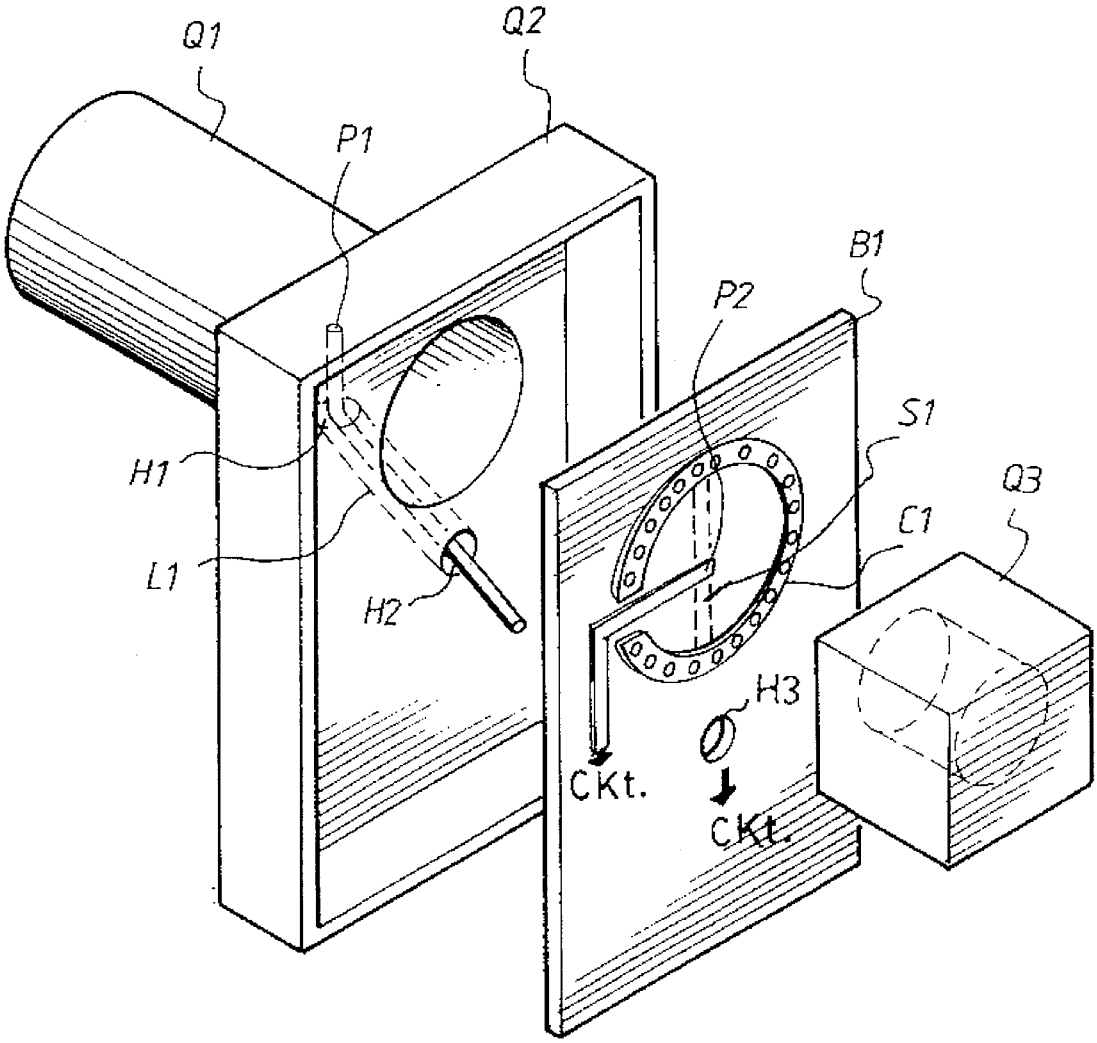
FIG. 3 depicts the preferred implementation of the present invention.
Figure 4:
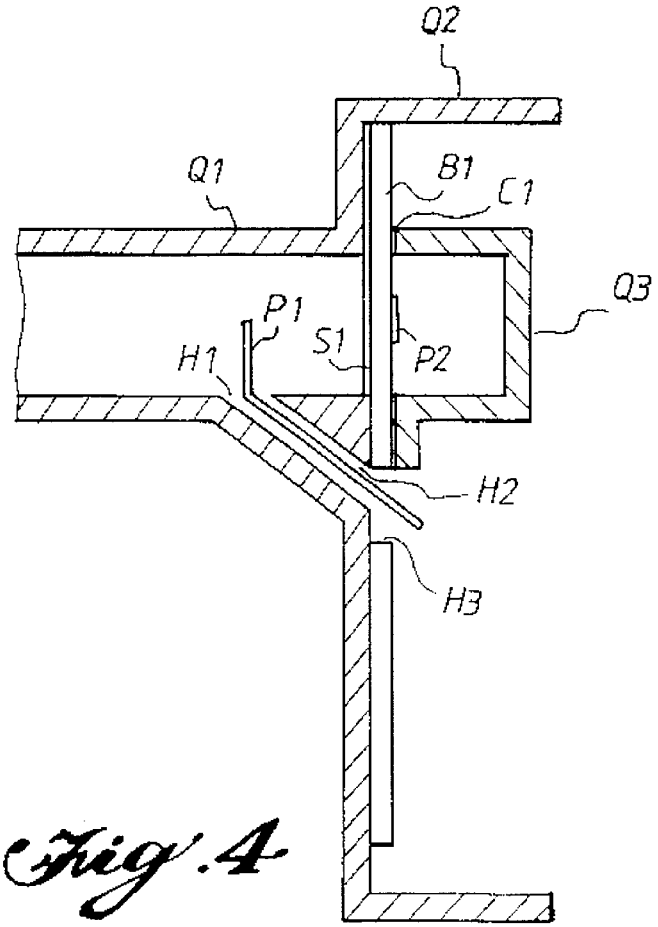
FIG. 4 depicts an elevational exploded view of the structure of the present invention.
Figure 5:
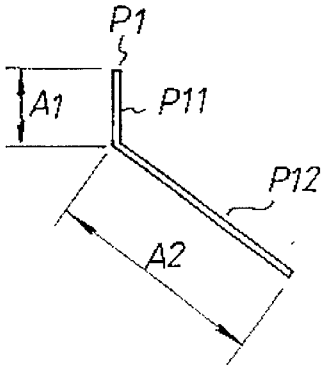
FIG. 5 is the structural diagram of the pin P1.

According to FIGS. 3 and 4, a cylindrical metal wave guide Q1 is connected perpendicular to the housing Q2. Printed circuit board (PCB) B1 is positioned inside the housing Q2, and the plane of the PCB is also perpendicular to the axis of the wave guide. A hole is hollowed out where the housing connects to the wave guide, and the radius of the hole is the same as the inner radius of the wave guide. Additionally, a tunnel L1 extends from the interior of the cylindrical wave guide Q1 to the housing Q2 with the exits at the wave guide end H1 and the housing end H2. Pin P1 is a thin metal stick bent at an angle that depends on the angle of connection with the circuit of the PCB B1. From the bending point, the metal pin can be divided into two parts, labelled as P11 and P12, shown in FIG. 5. The portion of the pin labelled as P11 exits from the tunnel at H1 into the cylindrical wave guide Q1. The portion of the pin labelled as P12 extends into the tunnel whereby only a small portion exits at H2 into the housing Q2 and connects with the circuit of the PCB. The length of the portion of the Pin labelled as P11 is approximately ¼ λg.

Figure 6A:
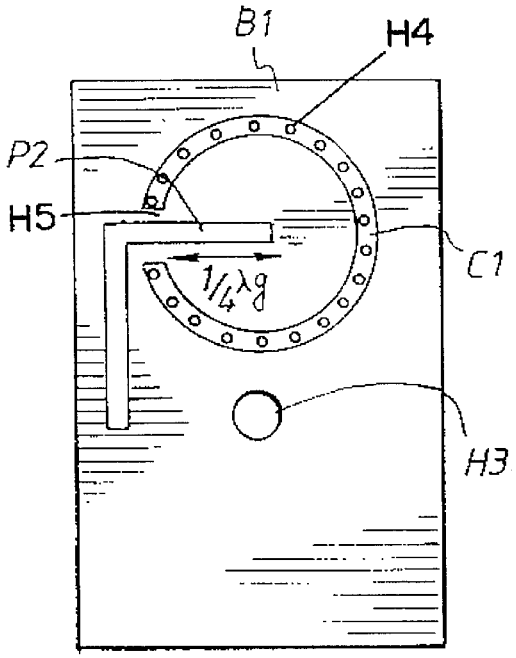
FIGS. 6A and 6B are the front and reverse views of the printed pin of the printed circuit board.

According to FIG. 6A, on the front of the PCB labelled as B1 (the side opposite to the wave guide Q1), there is etched a circular strip of soldered surface C1 having the same inner radius as the wave guide Q1. Further, small holes H4 are drilled as through holes. Via these through holes, the circular strip C1 is in contact with the surface of the under side (ground) of the PCB B1. There is also an opening H5 in the circular strip C1 so that the printed circuit pin P2 is allowed to pass through.

An example of the present implementation is that the portion of the metal pin P1 labelled as P11 is in the vertical position while the long strip of the printed circuit pin P2 is in the horizontal position. A separate hole H3 must be drilled on the PCB whereby the position of the hole overlaps with exit H2 of the tunnel L1 when the PCB and the housing are combined. This allows the pin P1 to exit and connect with the latter stage circuits, which includes amplifiers, down converters and other circuits. In other words, P1 is used as the entry point to the PCB for vertical signals. The length of the strip of the printed circuit pin P2 inside the circular strip of soldered surface is approximately ¼ λg. The other end is used as signal entry point for latter stage circuits.

Figure 6B:
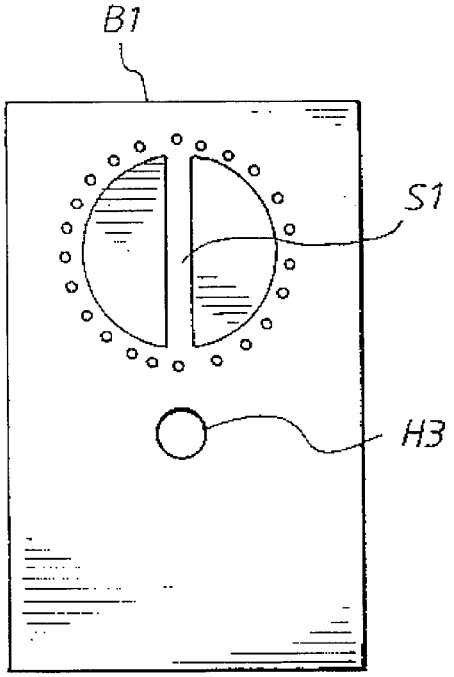

As shown in FIG. 6B, on the back side of the PCB B1, there is etched a circular area (the radius is the same as the inner radius of the cylindrical wave guide) where most of the soldered surface within the circular area is removed with the exception of a strip S1 that acts as a wire connection. The center of the circular area corresponds to the center of the circular strip C1 on the front side of the PCB. These two centers are on the same axis, and the portion P11 of the metal pin P1 is parallel to the axis and perpendicular to the pin P2.

As shown in FIGS. 3 and 4, Q3 is a metal cover having a closed end and the other end being a cylindrical opening having a depth of approximately ¼ λg. The radius is the same as the inner radius of the cylindrical wave guide Q1. Also, it is clear from FIG. 3 that the centers for the wave guide Q1, circular strip C1 on the PCB, and the metal cover Q3 all must be on the same axis thereby forming a cylindrical wave guide having a closed end.

Figure 7:
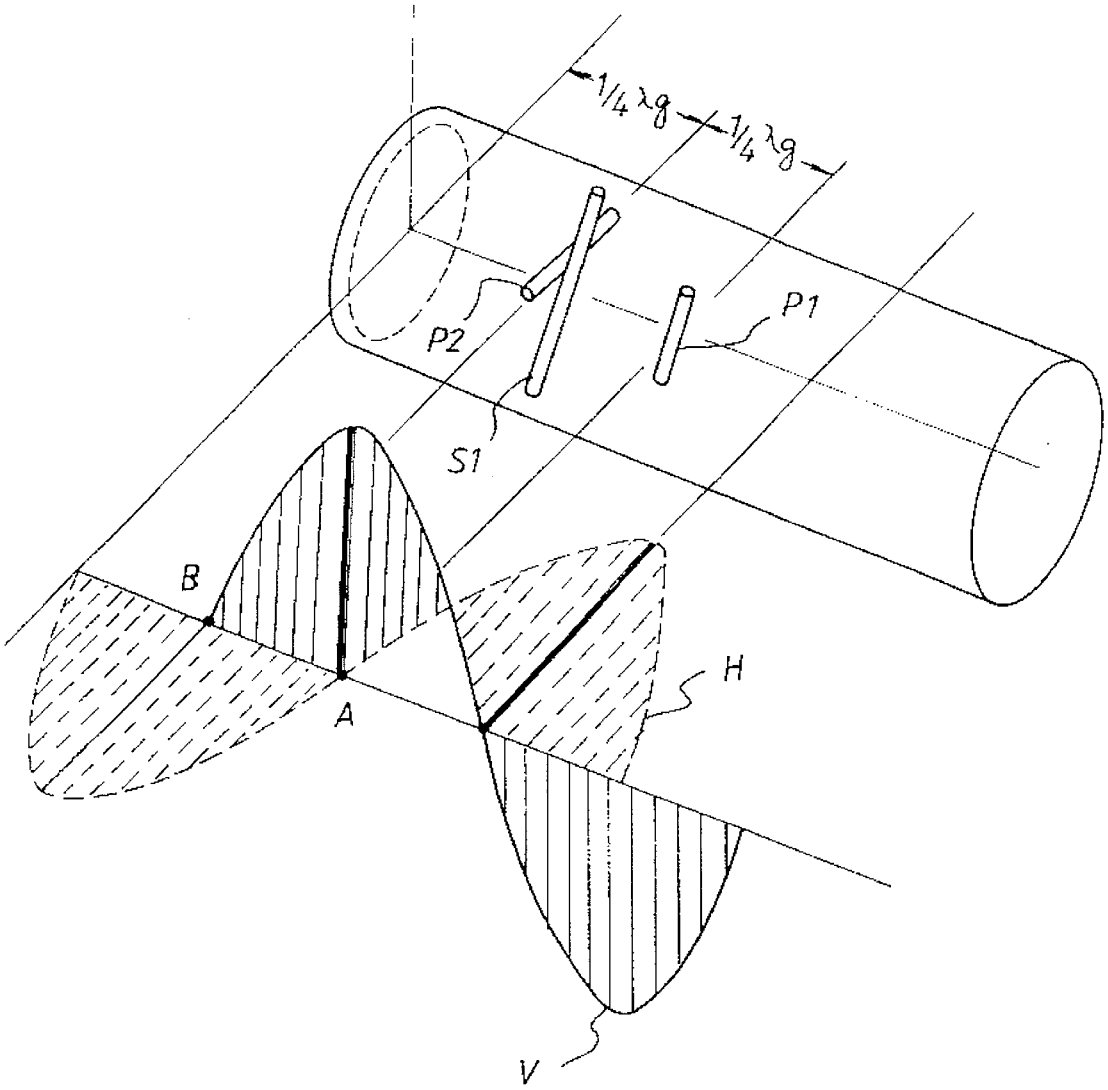
FIG. 7 is an analytical diagram of the transmission of electromagnetic waves.

FIG. 7 shows the positions of the pins of the present invention, and the transmission and reflection of the electromagnetic waves within the wave guide to better explain the functions of the pins. It is the design of the present invention that the level of energy for the horizontal signal H at pin P2 is at the maximum as the horizontal signal reflects off the metal cover Q3. At the same time, the energy level at pin P2 for the vertical signal V is at the minimum because the transmission is obstructed by the soldered strip S1. The energy level at pin P1 for the horizontal signal H is at the minimum as it reflects off the metal cover Q3. Conversely, the energy level of the vertical signal V at pin P1 is at the maximum as it reflects off the soldered strip S1. Therefore, at the position of pin P2 (point B on FIG. 7), the maximum horizontal signal and the minimum vertical signal can be received. Also, at the position of pin P1 (point A on FIG. 7), the minimum horizontal signal and the maximum vertical signal can be received. To implement the present invention, the distance between the metal cover Q3 and the printed pin P2 is approximately ¼ λg and the distance between the printed pin P2 and the metal pin P1 is also approximately ¼ λg. This installation provides the best possible isolation between vertical and horizontal signals.

Figure 8:
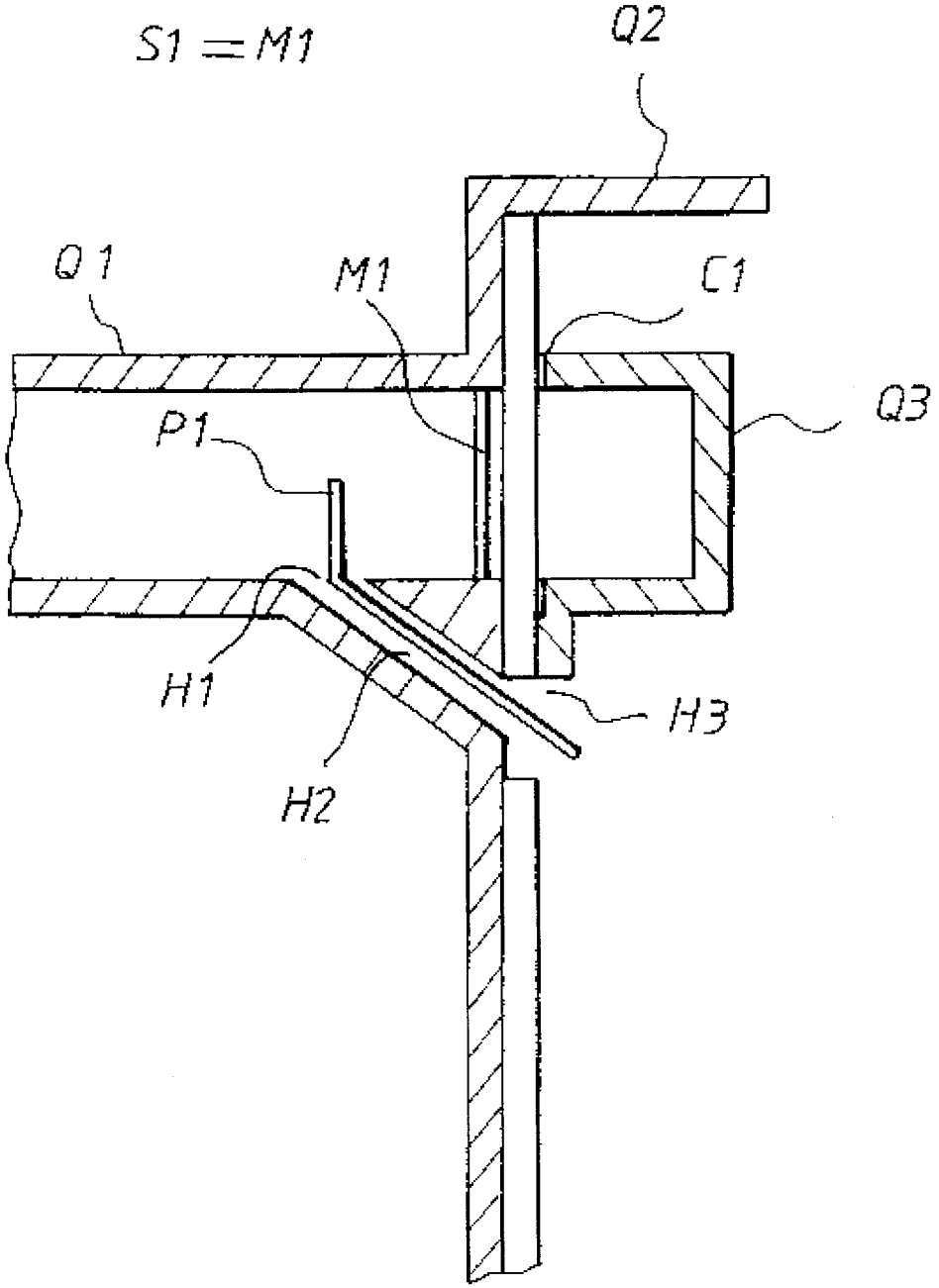
FIG. 8 is another preferred implementation of the present invention.

FIG. 8 depicts another example of the implementation of the present invention. The installation shown in FIG. 8 is approximately the same as that of FIG. 4, except the soldered strip S1 shown in FIG. 4 is replaced by a metal rod M1 in FIG. 8. By maintaining a distance of ¼ λg between the metal cover Q3 and the metal rod M1, and between the metal pin P1 and metal rod M1, the best possible isolation between vertical and horizontal signals is achieved.

Although the preset invention is described by using actual implementations, one skilled in the art may still make use of the invention under other implementations according to the spirit of creativity and substance of the present invention.

What is claimed is:

1. An electromagnetic wave conversion device which receives microwave signals entering from a wave guide connected to a housing and an axis of said wave guide being perpendicular to a plane of said housing, and said electromagnetic wave conversion device comprising:

a metal pin having one end extending out into said wave guide and the other end connecting with a circuit board within said housing thereby receiving a first component of said microwave signals as an input into a circuit of said circuit board;

a printed pin having one end perpendicular to said portion of said metal pin extending into said wave guide, and the other end connecting with said circuit board thereby receiving a second component of said microwave signals and using as input into the circuit of said circuit board;

said printed pin being a section of printed circuit on said circuit board on a side opposite said wave guide, said printed pin further being surrounded by but not intersecting with a circular strip of soldered surface having small through holes on said circuit board, on the other side of said circuit board there being a wire connection within a radius of said circular strip acting as a back short plane for said metal pin; and a metal cover, a bottom of which is the back short plane for said printed pin, radii for said metal cover, said circular strip of soldered surface and said wave guide being the same and forming a closed end of said cylindrical wave guide.

2. An electromagnetic wave conversion device as claimed in claim 1 wherein said first component of said microwave signals is vertical signals, and said second component is horizontal signals.

3. An electromagnetic wave conversion device as claimed in claim 1 wherein said metal pin reaches the housing through a tunnel extending from the wave guide to said housing.

4. An electromagnetic wave conversion device as claimed in claim 1 wherein said wire connection is the soldered strip remaining from etching a back side of said circuit board.

5. An electromagnetic wave conversion device as claimed in claim 1 wherein said metal pin and said wire connection are parallel and at a distance of approximately ¼ λg from one another.

6. An electromagnetic wave conversion device as claimed in claim 1 wherein a distance between said printed pin and the bottom of said metal cover is approximately ¼ λg.

7. An electromagnetic wave conversion device which receives microwave signals entering from a wave guide connected to a housing and an axis of said wave guide being perpendicular to a plane of said housing, and said electromagnetic wave conversion device comprising:

a metal pin having one end extending out into said wave guide, and the other end connecting with a circuit board within said housing thereby receiving a first component of said microwave signals as an input into a circuit of said circuit board;

a printed pin having one end perpendicular to a portion of said metal pin extending into said wave guide, and the other end connecting with said circuit board thereby receiving a second component of said microwave signals and using as input into the circuit of said circuit board;

said printed pin being a section of printed circuit on said circuit board on a side opposite said wave guide, said printed pin further being surrounded by but not intersecting with a circular strip of soldered surface having small through holes on said circuit board, on the other side of said circuit board there being tightly attached a metal rod within a radius of said circular strip acting as back short plane for said metal pin; and a metal cover, a bottom of which is the back short plane for said printed pin, radii for said metal cover, circular strip of soldered surface and said wave guide being the same and forming a closed end of a cylindrical wave guide.

8. An electromagnetic wave conversion device as claimed in claim 7 wherein said first component of said microwave signals is vertical signals, and said second component is horizontal signals.

9. An electromagnetic wave conversion device as claimed in claim 7 wherein said metal pin reaches the housing through a tunnel extending from the wave guide to said housing.

10. An electromagnetic wave conversion device as claimed in claim 7 wherein said metal pin and said wire connection are parallel and at a distance of approximately ¼ λg from one another.

11. An electromagnetic wave conversion device as claimed in claim 7 wherein a distance between said printed pin and the bottom of said metal cover is approximately ¼ λg.

* * * * *